US006988494B2

(12) United States Patent
Hassdenteufel et al.

(10) Patent No.: US 6,988,494 B2
(45) Date of Patent: Jan. 24, 2006

(54) METHOD FOR OPERATING AN INTERNAL COMBUSTION ENGINE

(75) Inventors: Armin Hassdenteufel, Sachsenheim-Ochsenbach (DE); Michael Pfeil, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/877,028

(22) Filed: Jun. 24, 2004

(65) Prior Publication Data

US 2005/0000503 A1 Jan. 6, 2005

(30) Foreign Application Priority Data

Jul. 3, 2003 (DE) ..... 103 30 092

(51) Int. Cl.
*F02D 41/14* (2006.01)

(52) U.S. Cl. ..... 123/674; 123/695

(58) Field of Classification Search ..... 123/674, 123/675, 688, 690, 691, 695, 696, 672, 679, 123/681–684; 701/109; 60/274, 276, 285
See application file for complete search history.

(56) References Cited

U.S. PATENT DOCUMENTS

| | | | | |
|---|---|---|---|---|
| 4,741,311 | A * | 5/1988 | Nakajima et al. | 123/675 |
| 5,117,631 | A | 6/1992 | Moser | 60/274 |
| 5,224,345 | A | 7/1993 | Schnaibel et al. | 60/274 |
| 6,176,227 | B1 * | 1/2001 | Ohuchi et al. | 123/698 |
| 6,283,108 | B1 * | 9/2001 | Matsufuji et al. | 123/690 |
| 6,397,830 | B1 | 6/2002 | Dohta | 123/684 |
| 6,604,357 | B2 * | 8/2003 | Bradley et al. | 123/674 |

FOREIGN PATENT DOCUMENTS

| | | | | |
|---|---|---|---|---|
| DE | 41 05 740 | | 9/1991 | |
| JP | 61053436 A | * | 3/1986 | 123/695 |
| JP | 07208242 A | * | 8/1995 | 123/695 |

* cited by examiner

*Primary Examiner*—Willis R. Wolfe, Jr.
(74) *Attorney, Agent, or Firm*—Kenyon & Kenyon

(57) ABSTRACT

A method for operating an internal combustion engine, permitting a differentiation between an air error and a fuel error as part of mixture adaptation. In at least one operating state of the internal combustion engine a deviation in an air-fuel mixture ratio from a setpoint value is corrected. For this correction in the at least one operating state the particular deviation in the air-fuel mixture ratio is determined for at least two setpoint values. From these deviations an air error and/or a fuel error is determined.

5 Claims, 2 Drawing Sheets

METHOD FOR OPERATING AN INTERNAL COMBUSTION ENGINE

BACKGROUND INFORMATION

It is already known that in at least one operating range of the internal combustion engine, a deviation in the air-fuel mixture ratio from a setpoint value is corrected. Systematic errors in the air-fuel mixture composition are corrected at the same time by the mixture adaptation. Essentially a distinction is made between additive and multiplicative errors. These mixture deviations are adapted in the load speed range in which they have the greatest effect. They are then calculated into the entire load speed range. Additive mixture deviations which occur because of leakage air or fuel injector delay times, for example, are adapted in a lower load speed range. Multiplicative mixture deviations which occur due to a characteristic line drift of the air flow meter used, for example, are adapted in a middle to upper load speed range. A correction value is formed for each adaptation range, i.e., each load speed range in which an adaptation was performed, and this correction value is interpreted as a fuel error. In the case of an air error, e.g., due to a leakage in the intake manifold, this error is also corrected in the fuel path instead of in the air path.

SUMMARY OF THE INVENTION

The method according to the present invention for operating an internal combustion engine has the advantage over the related art that for correcting the deviation in the air-fuel mixture ratio from the setpoint value in the at least one operating range the particular deviation in the air-fuel mixture ratio is determined for at least two setpoint values and an air error and/or a fuel error is/are determined from these deviations. It is possible in this way to differentiate between an air error and a fuel error. It is therefore possible to correct errors in the air path at the correct location, namely in the air path itself. The same thing is true of the correction of errors in the fuel path which are also corrected at the correct location, namely in the fuel path, and their correction does not include the air errors. Air errors therefore need not be compensated by the driver by corresponding operation of the gas pedal. In addition, the correction of the deviation in the air-fuel mixture ratio from the setpoint value is implemented according to the present invention without any additional sensors.

It is particularly advantageous if the air error and/or the fuel error is/are determined by using an equation system having at least two equations for the deviation in the air-fuel mixture ratio from the particular setpoint value. In this way the air error and/or the fuel error may be determined precisely and differentiated from one another with little effort.

An additional advantage results if the air error is corrected only in an air path of the internal combustion engine. In this way air errors need not be compensated by the driver through corresponding operation of the gas pedal. In addition this makes it unnecessary to correct the air error in the fuel path.

An additional advantage results if the fuel error is corrected only in a fuel path of the internal combustion engine. In this way fuel errors need not be compensated by the driver through corresponding operation of the gas pedal.

An additional advantage results if only one error from the quantity formed by the air error and the fuel error is determined and corrected and when any remaining deviation in the air-fuel mixture ratio from the setpoint value is interpreted as being based on that error which was not previously determined. It is possible in this way to avoid the calculation of an error in the quantity formed by the air error and the fuel error and thus to eliminate complexity while nevertheless being able to identify and correct this error.

DETAILED DESCRIPTION

Figure 1:
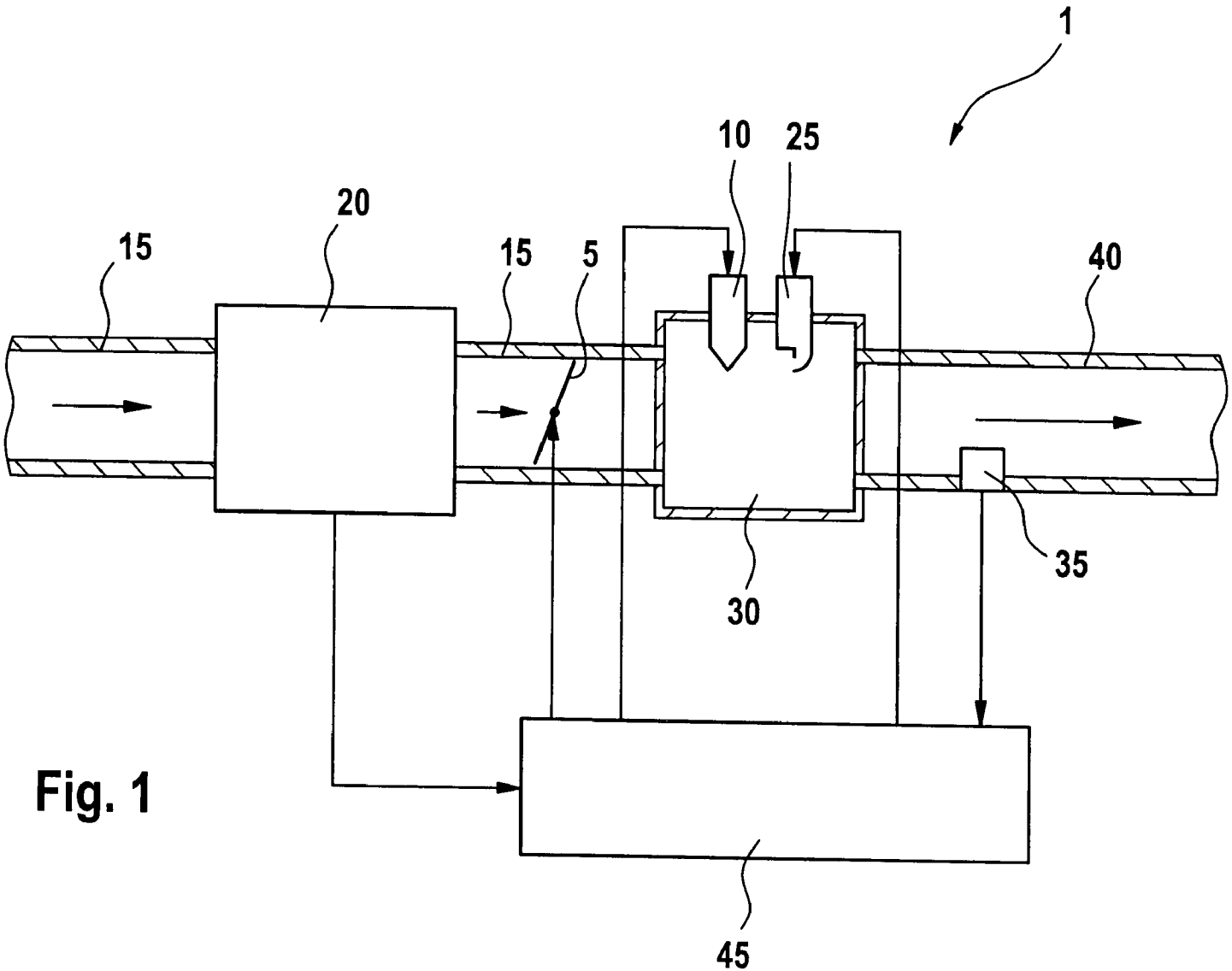
FIG. 1 shows a block diagram of an internal combustion engine.

FIG. 1 shows an engine 1 in a vehicle, for example. Engine 1 includes an internal combustion engine 30, which may be designed as a gasoline engine, for example. Internal combustion engine 30 receives fresh air through an air inlet 15. An air flow meter 20 situated in air inlet 15 may be designed as a hot-film air-mass meter, for example, which measures fresh air mass flow $\dot{m}_{air}$ supplied to internal combustion engine 30 and sends the result of the measurement to a control unit 45. The direction of flow of the fresh air in air inlet 15 is indicated by arrows in FIG. 1. A throttle valve 5 for adjusting and correcting fresh air mass flow $\dot{m}_{air}$ supplied to internal combustion engine 30 is situated downstream from air flow meter 20 in the direction of flow of the fresh air in air inlet 15. Therefore throttle valve 5 is triggered by control unit 45. Fresh air mass flow $\dot{m}_{air}$ is then sent through at least one intake valve (not shown in FIG. 1) to a combustion chamber (also not shown) of internal combustion engine 30. In addition, fuel is supplied to the combustion chamber through at least one fuel injector 10, with the quantity of fuel supplied also being adjusted and corrected by control unit 45. According to FIG. 1 direct injection of fuel into the combustion chamber of internal combustion engine 30 is indicated. As an alternative, fuel could also be injected into the area of air inlet 15 which is situated between throttle valve 5 and the at least one intake valve and is referred to as an intake manifold. In addition the air-fuel mixture in the combustion chamber of internal combustion engine 30 is ignited by at least one spark plug 25 which to this end is also triggered by control unit 45 for adjusting a suitable ignition point. Through combustion of the air-fuel mixture in the combustion chamber of internal combustion engine 30, engine 1 is driven in a manner with which those skilled in the art are familiar.

The exhaust gas formed during combustion is ejected from the combustion chamber into an exhaust line 40 through at least one outlet valve (not shown in FIG. 1), the direction of flow of the exhaust gas in exhaust line 40 also being indicated by an arrow in FIG. 1. A lambda-probe 35 is situated in exhaust line 40, measuring the oxygen content in the exhaust gas and sending the measured value to control unit 45 in which an actual value for air-fuel mixture ratio λ in the combustion chamber of internal combustion engine 30 is then calculated from the measured oxygen content by a method with which those skilled in the art are familiar.

Air-fuel mixture ratio λ in the combustion chamber of internal combustion engine 30 is defined as follows:

$$\lambda = \frac{\dot{m}_{air}}{\dot{m}_{kr} \cdot ml_{\min}} \tag{1}$$

where $\dot{m}_{kr}$ is the fuel mass flow and $ml_{min}$ is a predetermined fixed value indicating the mass in kilograms of air required to burn one kilogram of fuel. For commercial gasoline fuels, this fixed value currently amounts to approximately 14.7. Fuel mass flow $\dot{w}_{kr}$ is calculated from fresh air mass flow $\dot{m}_{air}$ and air-fuel mixture ratio λ from equation (1) as follows:

$$\dot{m}_{kr} = \frac{\dot{m}_{air}}{ml_{\min} \cdot \lambda}. \tag{2}$$

Error $\lambda_{error}$ of fuel-air mixture ratio λ is described by:

$$\lambda_{error} = \frac{\partial \lambda}{\partial \dot{m}_{Air}} \cdot \Delta \dot{m}_{Air} + \frac{\partial \lambda}{\partial \dot{m}_{kr}} \cdot \Delta \dot{m}_{kr}, \tag{3}$$

where $\Delta\dot{m}_{air}$ is the error in the air path of engine 1 and $\Delta\dot{m}_{kr}$ is the error in the fuel path of engine 1. The air path refers to the supply of fresh air to internal combustion engine 30 through air inlet 15, air flow meter 20, and throttle valve 5. Error $\Delta\dot{m}_{air}$ in the air path is caused for example due to a leak in air inlet 15, e.g., in the area of the intake manifold or due to a characteristic line offset of air flow meter 20. The fuel path refers to the supply of fuel to internal combustion engine 30 through at least one fuel injector 10. Error $\Delta\dot{m}_{kr}$ in the fuel path is caused for example by fuel injector delay times.

Depending on the operating range, i.e., the load speed range of engine 1, a corresponding setpoint value $\lambda_{setpoint}$ for the fuel-air mixture ratio may be predetermined. A λ regulation (not shown separately in FIG. 1) in control unit 45 regulates an actual value $\lambda_{actual}$ for the air-fuel mixture ratio according to setpoint value $\lambda_{setpoint}$. To this end, a regulating factor fr is formed in a manner with which those skilled in the art are familiar and is used to correct the fuel supply through at least one fuel injector 10 for readjusting actual value $\lambda_{actual}$ for the air-fuel mixture ratio to setpoint value $\lambda_{setpoint}$ for the air-fuel mixture ratio. If regulating factor fr=1, then no correction is necessary and actual value $\lambda_{actual}$ for the air-fuel mixture ratio already corresponds to setpoint value $\lambda_{setpoint}$ for air-fuel mixture ratio λ. There is no mixture deviation then. In the case of a mixture deviation, fr≠1 and the fuel supply is corrected so that actual value $\lambda_{actual}$ for the air-fuel mixture ratio largely corresponds to setpoint value $\lambda_{setpoint}$ for the air-fuel mixture ratio. Error $\lambda_{error}$ of air-fuel mixture ratio λ then ultimately corresponds to the mixture deviation of actual value $\lambda_{actual}$ for air-fuel mixture ratio λ from setpoint value $\lambda_{setpoint}$ for the air-fuel mixture ratio that would be established for a regulating factor fr=1. Error $\lambda_{error}$ of air-fuel mixture ratio λ is calculated here in control unit 45 from actual regulating factor fr in a manner with which those skilled in the art are familiar. To reduce the complexity, error $\lambda_{error}$ of air-fuel mixture ratio λ may be determined approximately by the deviation of the actual value for regulating factor fr from value 1. For compensation of fluctuations in the actual value for regulating factor fr, this regulating factor fr may be averaged by an integrator, for example, with a correspondingly large time constant.

The derivations in air-fuel mixture ratio λ according to its variables are:

$$\frac{\partial \lambda}{\partial \dot{m}_{air}} = \frac{1}{\dot{m}_{kr} \cdot ml_{\min}} \tag{4}$$

-continued $$\frac{\partial \lambda}{\partial \dot{m}_{kr}} = -\frac{\dot{m}_{air}}{\dot{m}_{kr} \cdot \dot{m}_{kr} \cdot ml_{\min}}. \tag{5}$$

Fuel mass flow $\dot{m}_{kr}$ is replaced according to equation (2):

$$\frac{\partial \lambda}{\partial \dot{m}_{air}} = \frac{\lambda}{\dot{m}_{air}} \tag{6}$$

$$\frac{\partial \lambda}{\partial \dot{m}_{kr}} = -\frac{\lambda^2}{\dot{m}_{Air}}. \tag{7}$$

Error $\lambda_{error}$ of air-fuel mixture ratio λ is then obtained as follows from equations (3), (6), and (7):

$$\lambda_{error} = \frac{\lambda}{\dot{m}_{air}} \cdot \Delta \dot{m}_{air} - \frac{\lambda^2}{\dot{m}_{air}} \cdot \Delta \dot{m}_{kr}. \tag{8}$$

In the adaptation of the mixture deviation to date, a general error in the composition of the mixture, i.e., the air-fuel mixture ratio, was measured at a constant λ value of 1.0, for example. Since there is only one λ value per load point, with the particular load point being characterized by a corresponding value for fresh air mass flow $\dot{m}_{air}$, it is impossible to differentiate between fuel errors and air errors. However, if two different λ values are set at one load point, this yields two equations with two unknowns. This equation system is solvable. It is thus possible to differentiate between fuel errors and air errors. Fresh air mass flow $\dot{m}_{air}$ for the particular load point is measured by air flow meter 20 and is therefore available in control unit 45 and is used in equation (8). Alternatively, fresh air mass flow $\dot{m}_{air}$ could be derived from an intake manifold pressure determined by an intake manifold pressure sensor using a model and a method with which those skilled in the art are familiar if such an intake manifold pressure sensor is available in the intake manifold of engine 1. The λ value used in equation (8) is the setpoint value $\lambda_{setpoint}$ for the air-fuel mixture ratio. Error $\lambda_{error}$ of air-fuel mixture ratio λ obtained for the air-fuel mixture ratio in the conversion of this setpoint value $\lambda_{setpoint}$ is determined as described above from the resulting actual regulating factor fr and is also used in equation (8). In equation (8) error $\Delta\dot{m}_{air}$ in the air path and error $\Delta\dot{m}_{kr}$ in the fuel path are unknown. Therefore if equation (8) is formulated for at least two different setpoint values $\lambda_{setpoint}$ for the air-fuel mixture ratio, this yields the desired equation system which is solvable according to error $\Delta\dot{m}_{air}$ in the air path, i.e., the air error, and error $\Delta\dot{m}_{kr}$ in the fuel path, i.e., the fuel error.

Due to the fact that the air error is differentiated from the fuel error, it is possible to correct the air error in only the air path of engine 1, i.e., through corresponding correction of the setting of throttle valve 5. Accordingly it is possible to correct the fuel error in only the fuel path of internal combustion engine 1, i.e., by correcting the injection quantity at the at least one fuel injector 10. To reduce computation complexity, it is also possible to calculate either only the air error or only the fuel error from equation system (8) having the at least two equations and to correct it in the corresponding path, for example. The remaining deviation, i.e., the remaining error in air-fuel mixture ratio λ, may be definitely identified as the error not calculated previously and may be corrected accordingly in the particular path, for example. The mixture adaptation described here may be performed for one or more load points, in particular in various operating ranges, i.e., in different load speed ranges of internal combustion engine 1.

Figure 2:
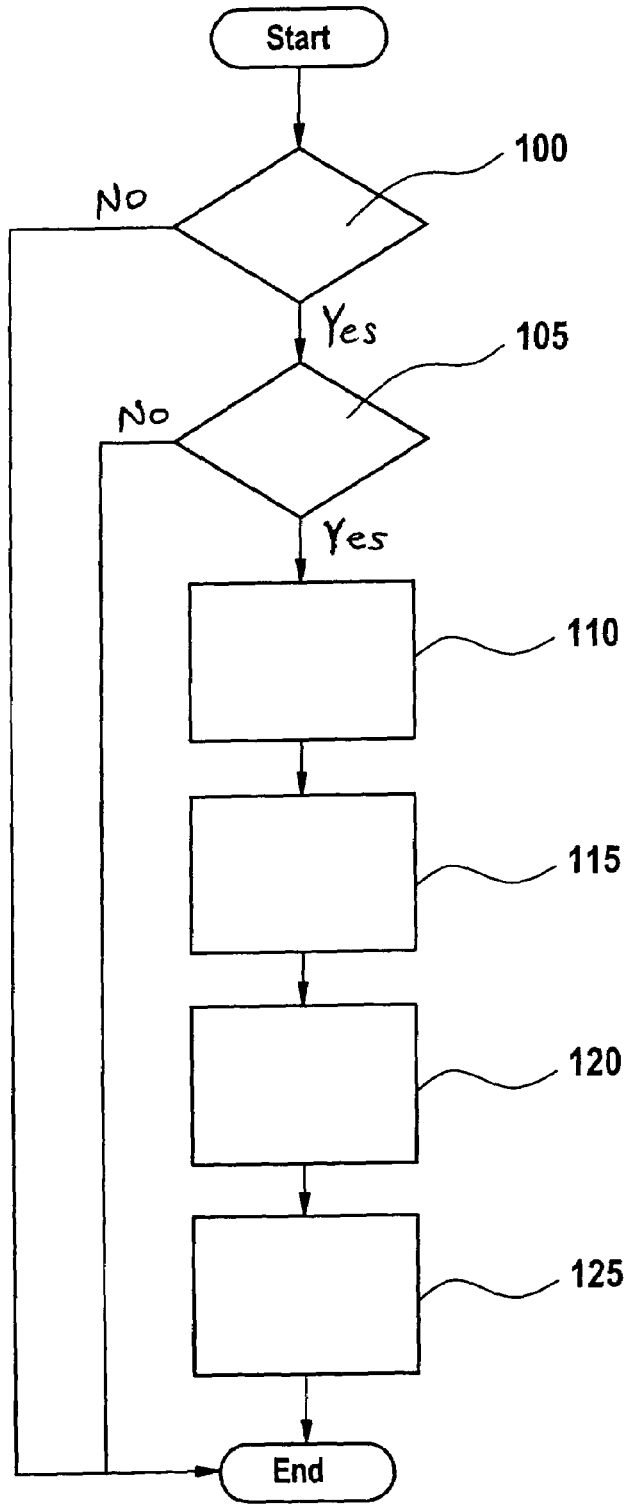
FIG. 2 shows a flow chart of an exemplary sequence of the method according to the present invention.

FIG. 2 shows a flow chart for an exemplary sequence of the method according to the present invention. After the start of the program, control unit 45 checks at a program point 100 on whether the λ regulation is active. If this is the case, then it branches off to a program point 105; otherwise the program is terminated.

At program point 105, control unit 45 checks on whether a mixture adaptation is possible. If this is the case, it branches off to a program point 110; otherwise the program is terminated. A mixture adaptation is not possible, for example, when tank ventilation is active. In addition, a mixture adaptation is possible only in a certain engine temperature range above a threshold temperature of approximately 60° C., for example. At program point 110, a first setpoint value $\lambda_{setpoint}$ for the air-fuel mixture ratio, e.g., the value 1, is predetermined for a given load point, characterized by a particular fresh air mass flow $\dot{m}_{air}$. First error $\lambda_{error}$ of air-fuel mixture ratio λ thus obtained is determined. Fresh air mass flow $\dot{m}_{air}$ first setpoint value $\lambda_{setpoint}$ for the air-fuel mixture ratio, and first error $\lambda_{error}$ of air-fuel mixture ratio λ are used in a first equation of the equation system according to equation (8). It then branches off to a program point 115. At program point 115 a second setpoint value $\lambda_{setpoint}$ for the air-fuel mixture ratio, e.g., the value 1.2, is predetermined for the given load point. This corresponds to a lean air-fuel mixture ratio. Second error $\lambda_{error}$ of air-fuel mixture ratio λ is then determined. Fresh air mass flow $\dot{m}_{air}$, second setpoint value $\lambda_{setpoint}$ for the air-fuel mixture ratio, and second error $\lambda_{error}$ of air-fuel mixture ratio λ are used in a second equation of the equation system according to equation (8). The system then branches off to a program point 120. At program point 120 a third setpoint value $\lambda_{setpoint}$ for the air-fuel mixture ratio, e.g., the value 0.8, is predetermined for the given load point. This corresponds to a rich air-fuel mixture ratio. Resulting third error $\lambda_{error}$ of air-fuel mixture ratio λ is determined. Fresh air mass flow $\dot{m}_{air}$, third setpoint value $\lambda_{setpoint}$ for the air-fuel mixture ratio, and third error $\lambda_{error}$ of air-fuel mixture ratio λ are used in a third equation of the equation system according to equation (8). The system then branches off to a program point 125.

At program point 125 the equation system formed from three equations according to the above equation (8) is solved for air error $\Delta\dot{m}_{air}$ and/or fuel error $\Delta\dot{m}_{kr}$ and a corresponding correction is made in the air path and in the fuel path as adaptation of the mixture and error $\lambda_{error}$ of air-fuel mixture ratio λ is compensated.

In the flow chart according to FIG. 2, three different setpoint values $\lambda_{setpoint}$ for the air-fuel mixture ratio at the given load point were used. To solve the equation system according to equation (8) for air error $\Delta\dot{m}_{air}$ and fuel error $\Delta\dot{m}_{kr}$ it is sufficient, however, to predetermine two different setpoint values $\lambda_{setpoint}$ for the air-fuel mixture ratio. Alternatively, more than three setpoint values $\lambda_{setpoint}$ for the air-fuel mixture ratio may be predetermined per load point to determine air error $\Delta\dot{m}_{air}$ and fuel error $\Delta\dot{m}_{kr}$ from the equation system according to equation (8).

What is claimed is:

1. A method for operating an internal combustion engine, the method comprising:

in at least one operating range of the internal combustion engine, correcting a deviation in an air-fuel mixture ratio from a setpoint value, wherein the correcting includes determining particular deviations in the air-fuel mixture ratio for at least two setpoint values and determining at least one of an air error and a fuel error as a function of the particular deviations, wherein the at least one of the air error and the fuel error is determined by using an equation system having at least two equations for a deviation in the air-fuel mixture ratio from a particular setpoint value.

2. A method for operating an internal combustion engine, the method comprising:

in at least one operating range of the internal combustion engine, correcting a deviation in an air-fuel mixture ratio from a setpoint value, wherein the correcting includes determining particular deviations in the air-fuel mixture ratio for at least two setpoint values and determining at least one of an air error and a fuel error as a function of the particular deviations, and correcting the air error only in an air path of the engine.

3. A method for operating an internal combustion engine, the method comprising:

in at least one operating range of the internal combustion engine, correcting a deviation in an air-fuel mixture ratio from a setpoint value, wherein the correcting includes determining particular deviations in the air-fuel mixture ratio for at least two setpoint values and determining at least one of an air error and a fuel error as a function of the particular deviations;

determining and correcting only one error from a quantity formed by the air error and the fuel error; and interpreting any remaining deviation in the air-fuel mixture ratio from the setpoint value as being based on an error which was not previously determined.

4. A method for operating an internal combustion engine, the method comprising:

for at least one load point of the engine, measuring at least a first air-fuel mixture ratio and a second air-fuel mixture ratio;

comparing the first and second air-fuel mixture ratios to two predetermined setpoint values to determine at least two air-fuel mixture errors;

determining at least one of an air error and a fuel error based on the at least two air-fuel mixture errors; and correcting the at least one of the air error and the fuel error.

5. The method according to claim 4, further comprising correcting the fuel error only in a fuel path of the engine.

* * * * *